US005786796A

United States Patent [19]

Takayama et al.

[11] Patent Number: 5,786,796

[45] Date of Patent: Jul. 28, 1998

[54] IMAGE DESPLAY DEVICE

[75] Inventors: Ichiro Takayama, Kanagawa; Michio Arai, Tokyo; Mitsufumi Codama, Kanagawa, all of Japan

[73] Assignees: TDK Corporation, Tokyo; Semiconductor Energy Laboratory Co., Ltd., Atsugi, both of Japan

[21] Appl. No.: 609,376

[22] Filed: Mar. 1, 1996

[30] Foreign Application Priority Data

Mar. 3, 1995 [JP] Japan ..... 7-43749

[51] Int. Cl.[6] ..... G09G 3/30; G09G 5/00; G09G 3/10

[52] U.S. Cl. ..... 345/76; 345/78; 345/80; 345/204; 315/169.3

[58] Field of Search ..... 345/76–80, 91, 345/204, 205, 206, 50, 58, 66, 87, 90, 92; 315/169.3; 437/40

[56] References Cited

U.S. PATENT DOCUMENTS

| | | | |
|---|---|---|---|
| 4,042,854 | 8/1977 | Luo et al. | 345/205 |
| 4,621,260 | 11/1986 | Suzuki et al. | 340/719 |
| 4,937,566 | 6/1990 | Clerc | 345/206 |
| 5,079,483 | 1/1992 | Sato | 345/76 |
| 5,095,248 | 3/1992 | Sato | 345/76 |
| 5,550,066 | 8/1996 | Tang et al. | 437/40 |

FOREIGN PATENT DOCUMENTS

| | | | |
|---|---|---|---|
| 2-148687 | 6/1990 | Japan . | |
| 5-945150 | 8/1991 | Japan | 345/76 |
| 4-137392 | 5/1992 | Japan . | |
| 5-35207 A | 12/1993 | Japan | 345/77 |

OTHER PUBLICATIONS

"A 6 X 6–in 20–Ipi Electroluminescent Display Panel", Brody et al, IEEE *Transactions on Electron Devices*, vol. ED–22, No. 9, Sep. 1975, pp. 739–748.

*Primary Examiner*—Steven Saras
*Assistant Examiner*—David L. Lewis
*Attorney, Agent, or Firm*—Nikaido, Marmelstein, Murray & Oram LLP

[57] ABSTRACT

An image display device which is not affected by image control signal for other pixels and gives adjustable intensity based upon control signal is provided. The image display device has a thin film pixel element EL, a non-linear element 5 for emit control of said thin film pixel element EL, a signal hold capacitor C coupled with a gate electrode of said non-linear element 5, another non-linear element 6 for writing data into said capacitor C, and a resistor R coupled between said capacitor C and a fixed potential source. The resistance of said resistor R is larger than ON resistance and smaller than OFF resistance of said non-linear element 6 for data writing.

1 Claim, 5 Drawing Sheets

1
SCREEN
W
3
Y-SHIFT REGISTER
X-SHIFT REGISTER
2
EL SOURCE Eo
Y-SYNCHRONIZATION SIGNAL Yc
IMAGE DATA SIGNAL Di
X-SYNCHRONIZATION SIGNAL Xc
SHIFT REGISTER SOURCE SR

XD2
10-4
Eo
XD1
10-3
Eo
C4
11-4
EL4
12-4
C3
11-3
EL3
12-3
Y2
Y-SHIFT REGISTER
C2
11-2
EL2
12-2
C1
11-1
EL1
12-1
Y1
3
10-2
10-1
14
13
IMAGE DATA SIGNAL Di
X2
X1
X-SHIFT REGISTER

IMAGE DESPLAY DEVICE

BACKGROUND OF THE INVENTION

The present invention relates to an image display device, in particular, relates to such a device which provides adjustable intensity according to control signal.

A prior electro-luminescence (EL) image display device is shown in FIG. 4A, which has a display screen 1 constituted by electro-luminescence elements (EL), a shift register 2 for providing X-axis signal, and a shift register 3 for providing Y-axis signal. The display screen 1 receives EL power source $E_0$ and the shift register 3 for Y-axis receives Y-axis synchronization signal $Y_C$ and the shift register power source SR. The shift register 2 for X-axis receives the image data signal $D_i$, the X-axis synchronization signal $X_C$ and the shift register power source SR.

FIG. 4B shows enlarged view of the part W in the screen 1 in FIG. 4A, showing four pixels 10-1, 10-2, 10-3 and 10-4. The pixel 10-1 has a thin film electro-luminescence element $EL_1$ for light emitting, a thin film transistor (TFT) 11-1 for providing bias potential to control light emitting by said electro-luminescence element $EL_1$, a capacitor $C_1$ coupled with a gate electrode of said bias thin film transistor (TFT) 11-1, and Y-axis select switch 12-1 for writing signal into said capacitor $C_1$. Other pixels 10-2, 10-3 and 10-4 have the similar structure to that of 10-1.

The Y-axis select switch 12-1 is for instance implemented by a thin film transistor (TFT) with a gate electrode connected to a terminal $Y_1$ of the shift register 3. The Y-axis select switch 12-1 is further connected to the X-axis select switch 13. The X-axis select switch 13 is implemented for instance by a thin film transistor (TFT) with a gate electrode connected to a terminal $X_1$ of the shift register 2. The X-axis select switch 13 receives image data signal $D_i$.

Accordingly, when a synchronization signal is provided to the terminal $Y_1$ in the Y-axis shift register 3, the Y-axis select switches 12-1, 12-2 et al turn ON. At that time, when a synchronization signal is provided to the terminal $X_1$ in the X-axis shift register 2, the X-axis select switch 13 turns ON, so that an image data signal $D_1$ applied to the X-axis select switch 13 is kept in the capacitor $C_1$ through the Y-axis select switch 12-1. Next, when a synchronization signal is provided to the terminal $X_2$, the X-axis select switch 13 turns OFF and the X-axis select switch 14 turns ON, so that an image data signal $D_2$ applied to the X-axis select switch 14 is kept in the capacitor $C_2$ through the Y-axis select switch 12-2. Thus, the Y-axis select switches 12-1, 12-2, et al function as a select switch to keep charge in capacitors $C_1$, $C_2$, et al, according to image data signal.

Thus, capacitors $C_1$, $C_2$, et al keeps image data signals $D_1$, $D_2$ et al so that a bias thin film transistors (TFT) 11-1, 11-2 et al turns ON, and an electro-luminescence elements $EL_1$, $EL_2$ et al emits light according to an image data signal $D_1$, $D_2$ et al. After pixels 10-1, 10-2 et al on a terminal $Y_1$ emits light, a synchronization signal is supplied to the terminal $Y_2$ in the Y-axis shift register 3, and pixels 10-3, 10-4 et al emits light similarly. Electro-luminescence elements $EL_1$, $EL_2$ et al is for instance constituted by an organic EL element.

In such an EL image screen device which has, for each pixel, a thin film EL element, a non-linear element like a bias thin film transistor (TFT) for light emission control of said EL element, a capacitor for keeping a signal coupled with a gate electrode of said non-linear element, another non-linear element including a Y-axis select switch for writing data in said capacitor for keeping signal, the intensity of light emission of an EL element depends upon potential kept in the capacitor for keeping signal, and the light emission is static. Such an EL image screen device is for instance shown in A66-in 20 lpi Electroluminescent Display Panel T. p. Brody, F. C. Luo, et al., IEEE Trans, Electron Devices, Vol. ED-22, No.9, Sep. 1975, (pages 739–749).

However, charge kept in such a capacitor is lost by leak current during off period of a non-linear element for data writing, and further, the amount of the charge to be lost depends upon pattern of information to be displayed.

FIG. 5 shows a single element of a display screen in FIG. 4. There is an EL element EL for light emission with one end connected to a common electrode COM, and the other end connected to a bias thin film transistor (TFT) 11 which controls light emission of the EL element EL. The bias thin film transistor (TFT) 11 is supplied with fixed potential VD (which corresponds to $E_0$ in FIG. 4), and a gate electrode of the transistor 11 is coupled with a signal hold capacitor C. A Y-axis select switch 12 is coupled with said signal hold capacitor C.

However, the charge in the signal hold capacitor C leaks through the Y-axis select switch 12, and the leakage changes bias potential to the EL element EL to deteriorate picture quality. The amount of leakage depends upon potential $X_i$ on the Y-axis select switch 12. For instance, in FIG. 4B, the leak current of the capacitor $C_3$ in the element 10-3 depends upon the resistance of the Y-axis select switch 12-3 during OFF state, and the connection potential of said Y-axis select switch 12-3.

The connection potential of the Y-axis select switch 12-3 is affected by the potential on another Y-axis select switch 12-1 for other pixels (when no synchronization signal is applied on the terminal $Y_2$), and the potential on the common data line $XD_1$ on the X-axis to which the Y-axis select switch 12-3 (and another Y-axis select switch 12-5 for a pixel 10-5, et al, not shown) is connected.

However, since an EL image screen device must indicate any pattern, and therefore, estimate of leak current which depends upon a pattern to be displayed is impossible.

Accordingly, a Y-axis select switch must have extremely high resistance during OFF state. Simultaneously, it must have low resistance during ON state in order to charge a signal hold capacitor with image data in limited writing time. The writing time is the shorter when resolution is high and number of pixels on a screen is large. Therefore, extremely high resistance during OFF state and extremely low resistance during ON state must be satisfied. Therefore, conventionally, selection of producing method of a non-linear element is restricted, and it has been difficult to reduce producing cost, and to provide a screen with large area, high picture quality, and high resolution.

SUMMARY OF THE INVENTION

It is an object of the present invention to provide an image display device in which intensity of each pixel is defined by the related control signal, but not affected by control signals of adjacent pixels.

In order to achieve said object, the present invention has a discharge resistor R coupled parallel with a signal hold capacitor C which is connected to a gate electrode of a bias thin film transistor (TFT) 5 for an EL element EL, as shown in FIG. 1.

Resistance of said resistor R is lower (during OFF state) than resistance of a select switch 6 which is a non-linear element for data writing, and is higher than that during ON state. In FIG. 1, the symbol COM is a common electrode, and VD is fixed potential.

In FIG. 1, the select switch 6 turns ON by a Y-axis shift register (not shown). When image data signal D is applied to the capacitor C from X-axis potential $X_i$ during ON state, the capacitor C is charged depending upon the image data signal D, and an EL element EL emits light depending upon said image data signal D.

Then, when the select switch 6 turns OFF, the capacitor 6 discharges to a fixed potential (COM in FIG. 1) through the resistor R. Therefore, the discharge operation of the capacitor C is not affected by state of adjacent pixels.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 2A:
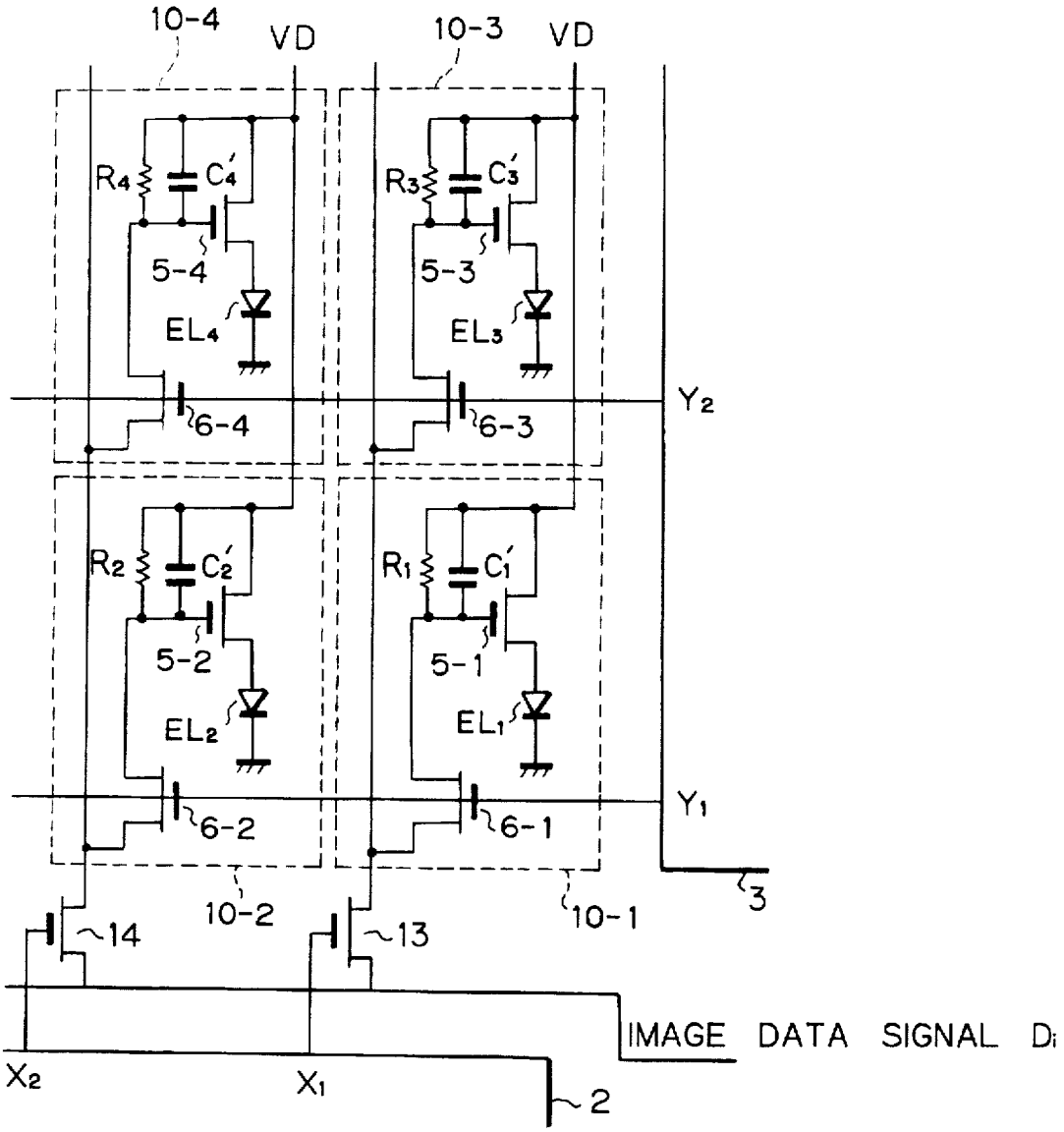
FIG. 2A shows a circuit diagram of the embodiment of the present invention.

The embodiment of the present invention is described in accordance with FIG. 2A. In FIG. 2A, the numeral 2 is an X-axis shift register, 3 is a Y-axis shift register, 10-1, 10-2, 10-3, 10-4, et al are a pixel constituting a screen.

A pixel 10-1 has a thin film electro-luminescence element $EL_1$ for light emission, a bias thin film transistor (TFT) 5-1 for controlling emission of said EL element $EL_1$, a capacitor $C_1'$, coupled with a gate electrode of said bias thin film transistor (TFT) 5-1, a resistor R coupled parallel with said capacitor $C_1'$, and a Y-axis select switch 6-1 for writing signal to said capacitor $C_1'$. Other pixels 10-2, 10-3, 10-4, . . . are similar to the pixel 10-1.

The Y-axis select switch 6-1 is implemented for instance by a thin film transistor TFT with a gate electrode connected to a terminal $Y_1$ of the shift register 3. The Y-axis select switch 6-1 is further connected to an X-axis select switch 13. The latter X-axis select switch 13 is implemented for instance by a thin film transistor TFT with a gate electrode connected to a terminal $X_1$ of a shift register 2. An image data signal D is applied to the X-axis shift register 13.

In the above structure, in the Y-axis shift register 3, when a synchronization signal is applied to the terminal $Y_1$ the Y-axis select switches 6-1, 6-2 et al are turned ON.

At that time, when a synchronization signal is applied to the terminal $X_1$ of the X-axis shift register 2, the X-axis select switch 13 turns ON so that the image data signal $D_1$ applied to the X-axis select switch 13 charges the capacitor $C_1'$ through the Y-axis select switch 6-1 which functions as a select switch for writing. That turns ON the bias thin film transistor 5-1 so that the current flows in the EL element $EL_1$ according to the image data signal $D_1$. Thus, the light emission depending upon the image data signal $D_1$ is obtained.

Next, when a synchronization signal is applied to the terminal $X_2$ of the X-axis shift register 2, the X-axis select switch 14 turns ON so that the image data signal $D_2$ applied to the X-axis select switch 14 charges the capacitor $C_2'$ through the Y-axis select switch 6-2 which functions as a select switch for writing. That turns ON the bias thin film transistor 5-2 so that the current flows in the EL element $EL_2$ according to the image data signal $D_2$. Thus, the light emission depending upon the image data signal $D_2$ is obtained.

In the above manner, the capacitors $C_1'$, $C_2'$, · · · are charged by the image data signals $D_1$, $D_2$, · · ·, so that the bias thin film transistors 5-1, 5-2 · · · are turned ON, respectively, and the EL elements $EL_1$, $EL_2$ · · · emit light according to the image data signals $D_1$, $D_2$, · · · After the pixels 10-1, 10-2, · · · coupled with the terminal $Y_1$ are activated, the Y-axis shift register 3 provides synchronization signal to the terminal $Y_2$. Then, the pixels 10-3, 10-4 · · · are activated. The similar operation is carried out in the X-axis shift register 2 and the Y-axis shift register 3 to activate the whole screen.

Figure 2B:
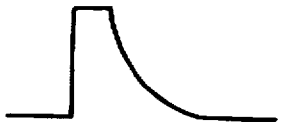
FIG. 2B is a waveform generated by the circuit of FIG. 2A.

In the present invention, the capacitor $C_1'$ has a parallel resistor $R_1$, the resistance of which is smaller than the resistance of a select switch 6-1 which is a non-linear element for data writing in OFF state. Similarly, the resistors $R_2$, $R_3$, $R_4$, · · · are coupled in parallel with the capacitors $C_2'$, $C_3'$, $C_4'$ · · · . Therefore, the charge in the capacitor $C_1'$ is discharged through the resistor $R_1$ during the OFF state of the select switch 6-1, as shown in FIG. 2B. The similar operation is effected to the capacitors $C_2'$, $C_3'$, $C_4'$ · · · . As the discharge of the capacitor $C_1'$ is carried out through the resistor $R_1$, the discharge operation is not affected by the adjacent pixels 10-3, · · ·, but the rate of discharge is constant. Similarly, the discharge of the capacitors $C_2'$, $C_3'$, $C_4'$ · · · is not affected by the adjacent pixels.

Since the charge in the capacitors $C_1'$, $C_2'$, $C_3'$, $C_4'$, is discharged with a predetermined time constant in the present invention, the light emission by an EL element is intermittent. In that case, a screen is observed as if it is continuous emission if writing frequency to each capacitor in each pixel is higher than the highest frequency that a man can recognize. The light intensity in the present invention is adjusted so that an average intensity in a second is the same as the desired intensity in static emission.

Figure 1:
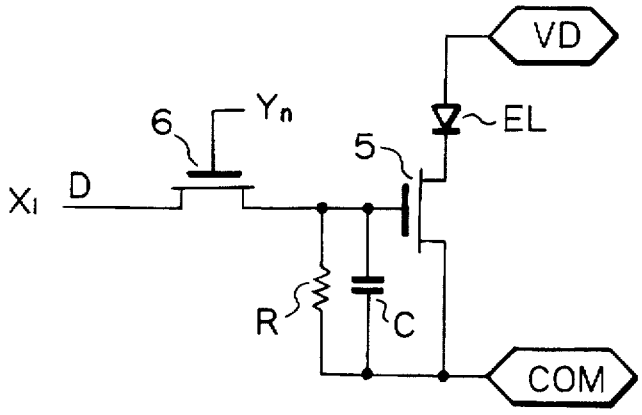
FIG. 1 shows basic diagram of the present invention.
Figure 3A:
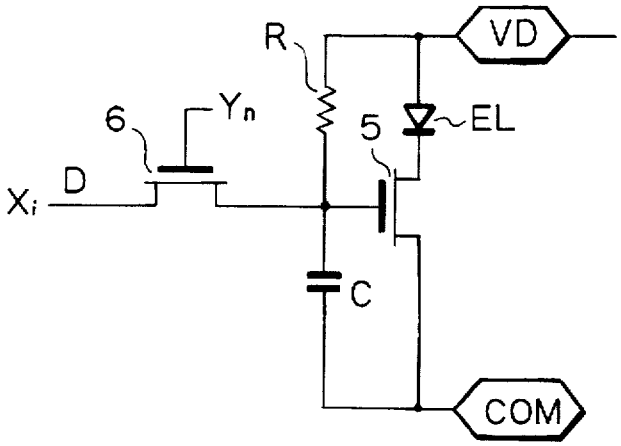
FIGS. 3A and 3B show other embodiments of the present invention.
Figure 3B:
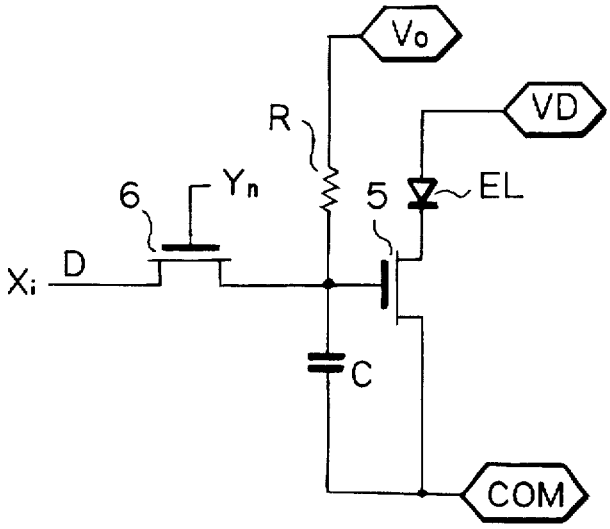
Figure 4A:
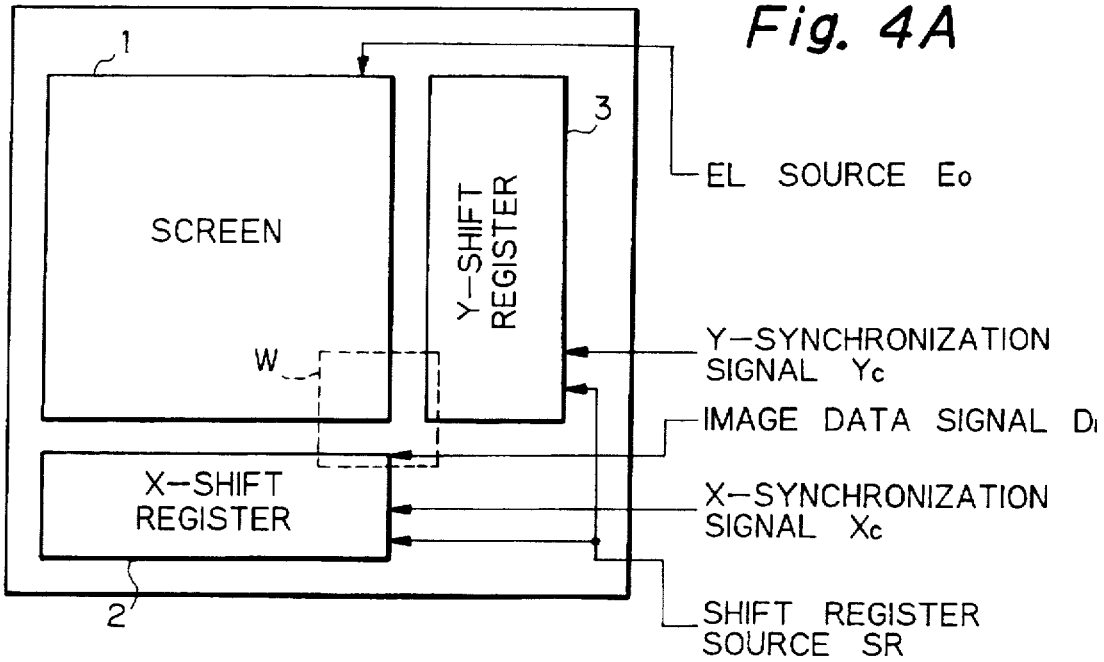
FIGS. 4A and 4B show a prior image display device.
Figure 4B:
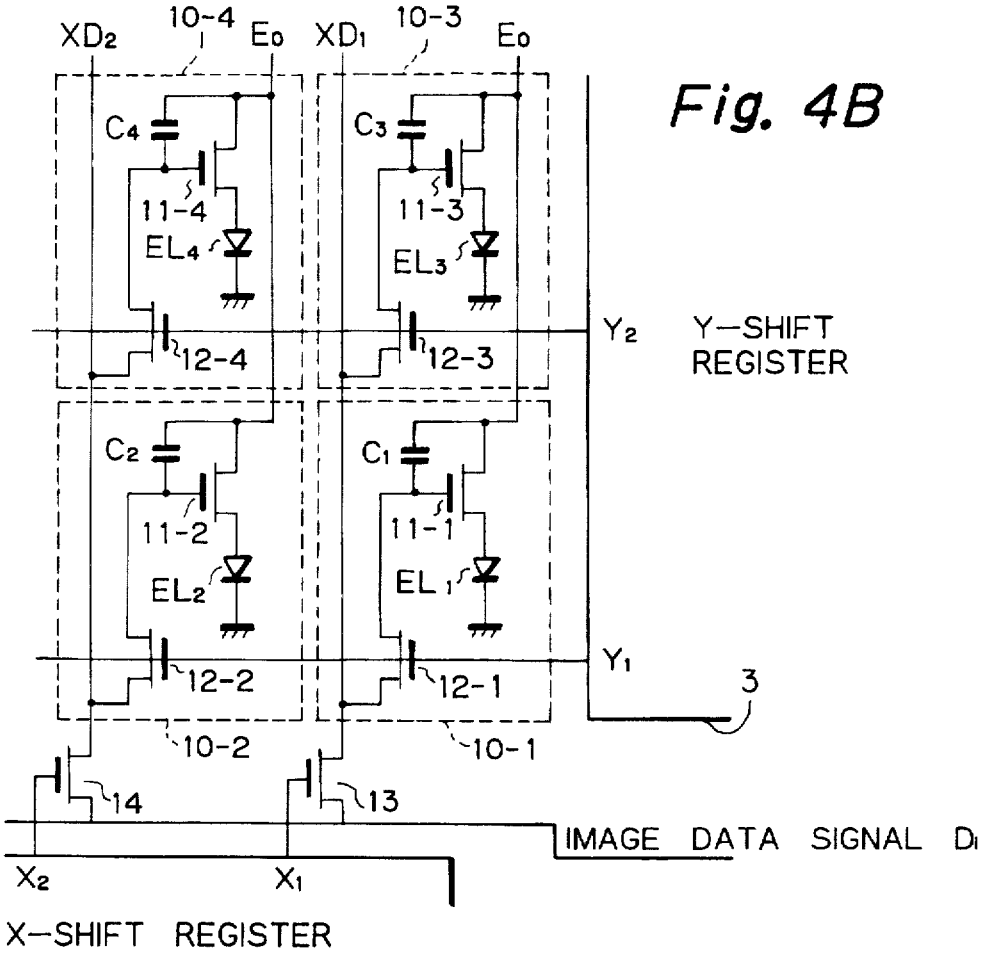
Figure 5:
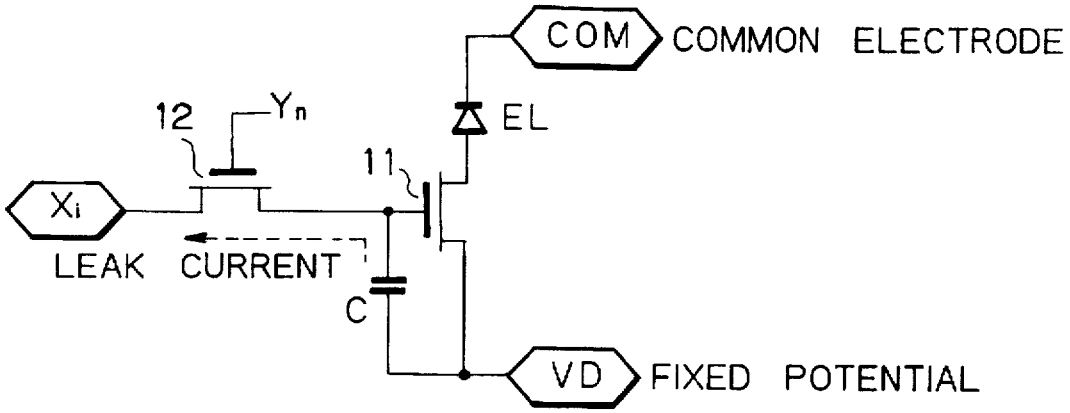
Fig. 5 PRIOR ART
FIG. 5 shows a structure for displaying a pixel.

Some modifications are shown in FIGS. 3A and 3B. In FIG. 3A, a resistor R is coupled between a capacitor C and a fixed potential VD. In FIG. 3B, another fixed potential $V_0$ which differs from the fixed potential VD is installed, and a resistor R is coupled between the fixed potential $V_0$ and a capacitor C. The operation in FIGS. 3A and 3B is similar to that of FIG. 1.

The polarity of an EL element is not restricted to that of the embodiments, but opposite polarity may be available. In that case, the polarity of fixed potential VD and common potential COM is of course reversed.

The resistance of the resistor R for discharge is preferably in the range between 2 times and $10^8$ times as large as that of a select switch in ON state, and still preferably it is between 1000 times and 10 times. And, it is preferably in the range between ½ times and $1/10^8$ times as large as that of a select switch in OFF state, and still preferably in the range between 1/10 times and 1/1000 times.

In the embodiment of FIG. 2A, the resistor and the capacitor are coupled with a fixed potential for a bias TFT. It should be noted of course that the present invention is not restricted to that, but the resistor and the capacitor may be coupled with another fixed potential, or COM electrode.

In the present invention, an EL element may be a thin film EL of organic EL. Although light is emitted intermittently in the present invention, it is almost continuous light, and therefore, no strong emission is necessary in the present invention. It is noted that it is not preferable for an organic EL to emit strong light for life time of an element, and therefore, it is preferable to emit softly. In this sense, the resistance of the resistor R is preferable that it is close to the resistance of a select switch in OFF state.

The use of the present invention is not restricted to an EL element, but an application to a liquid crystal display is possible.

By the way, the intermittent emit control of an EL element has been shown in JP patent laid open 4-137392, in which silent time (an EL does not emit) must be equal to temperature release time of an element. In the present invention, the silent time is not necessary equal to temperature release time of an element, and therefore, the present invention differs from that publication. Further, said publication does not show an embodiment of a circuit diagram, although it shows an operational waveform, and does not consider the object of the present invention, so, it differs completely from the present invention.

Further, JP patent laid open 2-148687 shows in FIG. 2 to prevent deterioration of picture quality due to OFF current leakage by using a current mirror circuit so that current of a current mirror circuit is controlled by an output of a memory cell by a MOS transistor. However, it is essentially half tone indication by using digital signal, and the circuit is extremely complicated, and it is not intermittent, and therefore, the publication differs from the present invention.

According to the present invention, a signal hold capacitor has a parallel resistor for discharge so that the resistance of the resistor is larger than that of a non-linear element for data writing in ON state, and is smaller than that in OFF state. Therefore, the resistance in OFF state of said data writing non-linear element is not necessarily extremely large with extremely small leak current, and therefore, the design choice of OFF state may be large. Further, we may have much design choice in producing method of a non-linear element, and it is easily obtained low cost screen, large area screen, high resolution screen, and high picture quality screen.

As we have much design choice to determine OFF resistance in an image display device using an EL element, and producing method of a non-linear element, it is easy to provide low cost of screen, large area screen, high resolution and high picture quality screen.

From the foregoing it has now been apparent that a new and improved image display device has been found. It should be appreciated of course that the embodiments disclosed are merely illustrative and are not intended to limit the scope of the invention. Reference should be made to the appended claims, therefore, indicating the scope of the invention.

What is claimed is:

1. An image display device comprising, for each pixel, a thin film display element, a first non-linear element for emit control of said thin film display element, a signal hold capacitor coupled with a gate electrode of said non-linear element, and a second non-linear element for writing data in said capacitor, wherein the improvement comprises that said display element is an organic EL element with one end coupled with a fixed potential and another end thereof coupled with said first non-linear element, and that a resistor is provided between said capacitor and a fixed potential so that a resistance of the resistor is larger than a resistance of said non-linear element for writing data in an ON state, and is smaller than the resistance of said non-linear element for writing data in an OFF state, wherein a resistance of said resistor is in the range between 2 times and $10^8$ times as large as that of said second non-linear element in ON state, and is in the range between ½ times and $1/10^8$ as large as that of said second non-linear element in OFF state.

* * * * *